US006325348B1

(12) United States Patent
Turner

(10) Patent No.: US 6,325,348 B1
(45) Date of Patent: Dec. 4, 2001

(54) QUICK DISCONNECT HINGE

(75) Inventor: William H. Turner, Melfa, VA (US)

(73) Assignee: Wood Tech, LLC, Melfa, VA (US)

( * ) Notice: Subject to any disclaimer, the term of this patent is extended or adjusted under 35 U.S.C. 154(b) by 0 days.

(21) Appl. No.: 09/689,805

(22) Filed: Oct. 13, 2000

Related U.S. Application Data

(63) Continuation of application No. 09/593,169, filed on Jun. 14, 2000.

(51) Int. Cl.[7] ..... A47B 97/02

(52) U.S. Cl. ..... 248/235; 248/240; 248/250; 248/441.1; 16/266

(58) Field of Search ..... 248/235, 240, 248/250, 291.1, 229.11, 229.21, 222.13; 108/52; 403/408.1, 388, 395, 335, 363, 375; 16/267, 268, 266

(56) References Cited

U.S. PATENT DOCUMENTS

| | | | | |
|---|---|---|---|---|
| 1,802,245 | * | 4/1931 | Foretich . | |
| 3,715,097 | | 2/1973 | Kalajian | 248/449 |
| 4,109,892 | | 8/1978 | Hartung | 248/449 |
| 4,404,914 | | 9/1983 | Taylor | 108/9 |
| 4,558,522 | | 12/1985 | Lance | 33/443 |
| 4,688,146 | * | 8/1987 | Newmark et al. | 361/364 |
| 4,703,910 | | 11/1987 | Ross | 248/463 |
| 4,824,064 | | 4/1989 | Oncale | 248/441.1 |
| 4,850,081 | * | 7/1989 | Grant | 16/257 |
| 5,004,204 | | 4/1991 | Cook | 248/449 |
| 5,005,795 | | 4/1991 | Holmgren | 248/449 |
| 5,172,883 | | 12/1992 | Amirian | 248/441.1 |
| 5,423,106 | * | 6/1995 | Peyret | 16/260 |
| 5,494,251 | | 2/1996 | Katz | 248/449 |
| 5,561,886 | * | 10/1996 | Flamme | 16/265 |
| 5,657,210 | * | 8/1997 | Yamanaka | 361/814 |
| 5,725,192 | | 3/1998 | Cloninger | 248/458 |
| 5,791,015 | * | 8/1998 | Wandinger | 16/228 |
| 5,799,803 | * | 9/1998 | Miller | 211/90.1 |
| 5,950,979 | | 9/1999 | Mira | 248/460 |

* cited by examiner

*Primary Examiner*—Leslie A. Braun
*Assistant Examiner*—Steven M. Marsh
(74) *Attorney, Agent, or Firm*—Millen, White, Zelano & Branigan, P.C.

(57) ABSTRACT

An adjustable easel is described that may be used by multiple persons and that may be modified according to the preferences of a user. The easel includes a plurality of vertical supports connected to each other. Holes are spaced apart along the length of the side edges of the vertical supports wherein each hole has a horizontal bore with the bore open to an edge of the vertical support. Horizontal support rods are adapted to slide in and out of the holes. Holders retain in place an artistic substrate wherein each holder is attached to at least one horizontal support rod.

4 Claims, 18 Drawing Sheets

QUICK DISCONNECT HINGE

This application is a continuation of U.S. application Ser. No. 09/593,169, filed on Jun. 14, 2000.

This invention relates to a graphic arts station, and specifically in one preferred embodiment, to an easel that can be adjusted with respect to height and tilt and can be modified with various modular component apparatuses to adapt to the needs and preferences of one or more persons using the easel.

BACKGROUND OF THE INVENTION

Traditionally, graphic arts stations have typically been embodied by easels in one form or another. Easels can be flimsy and awkward structures. Often, they are little more than a tripod with some adjustability in features, for instance, the length of the legs of the tripod. Also, past easels, tripods especially, only allow a single person to work on a single piece of art. These easels only allow work on a single side of the easel. It is inconvenient or impossible, for instance, for a person to safely move a canvas to allow it to dry.

Prior art easels are also very limited with respect to the additional features that can be incorporated in or attached to the easel. Conventional features include a bottom ledge to rest, for instance, a paint canvas on. Also, the easels may have a top bar to, for instance, clip watercolor paper onto. An artist, however, may require some shelf space, or a bulletin board, or other structures to facilitate the process of painting or drawing.

Another potential drawback of prior easels is the complicated nature of the components. The way in which the various parts of the easels are assembled together and modified can be complicated. There is a need for simple, yet sturdy, assemblies to facilitate modification and use of easels.

SUMMARY OF THE INVENTION

Accordingly, it is an objection of the present invention to overcome the foregoing drawbacks and limitations that are present in the prior art easel apparatuses.

In one embodiment, the invention is an easel that can be customized by a user. The easel has plurality of vertical supports that are connected to each other wherein the vertical supports have side edges. A plurality of holes are spaced apart along the length of the vertical supports, and each hole has a horizontal bore with the bore open to an edge of each vertical support; and further wherein there are corresponding holes in the vertical supports that are parallel to each other. Horizontal support rods are adapted to slide in an out of the holes. There are also holding means for retaining in place an artistic substrate wherein the holding means is attached to at least one horizontal support rod. The vertical supports may be A-frame supports. Also, the vertical supports may be connected to each other by themselves being rigidly attached to a horizontal supply bin. An additional component that may be included in the easel is a swivel panel. The swivel panel has a flat surface and a plurality of holes, the holes being in the cross-sectional width and having bores that are open on at least one side of the swivel panel so that the holes are adapted to receive the horizontal support rods. In a still further embodiment, the easel may have a variable tilt platform. The platform includes the plurality of parallel members having a flat edge on one side and a tilt arm having at least one hole in it. A plurality of holes is spaced apart along the length of the flat edged sides of the members wherein each hole has a horizontal bore with the bore open to the flat edges and further wherein there are corresponding holes in the members that are parallel to each other. The holes in the flat edged sides and in the arm are adapted to receive the horizontal support rods.

Another feature of the invention is a quick disconnect hinge that is made up of a male component and a female component. The male component includes a rod and a shelf, the shelf having top and bottom surfaces and sides, wherein one end of the top surface of the shelf is fixed to a rod, the rod having a circular cross-section. At least a portion of side of the shelf adjacent to the end of the top surface fixed to the rod protrudes outwardly from the diameter of the circular cross-section. The female component is a channel adapted to receive the male component. The cross-section of the channel has two sectors, the first sector being a partially circular curve that has a length less than half of the diameter of the entire circle defined by the partially circular curve. The second sector has a concave shape that connects the bottom end of the first sector to the side of the female component. The diameter of the circle defined by the curve of the first sector is at least the diameter of the rod portion of the male component.

In still a further embodiment of the present invention, a wall-mounted easel includes a plurality of vertical supports adapted to be mounted onto a wall wherein the vertical supports have side edges. Holes are spaced along the length of the vertical supports wherein each hole has a horizontal bore open to the side edge of each vertical support and further wherein there are corresponding holes in the vertical supports that are parallel to each other. The horizontal support rods are adapted to slide in and out of the holes. Holding means for retaining in place an artistic substrate are attached to at least one horizontal support rod.

In a further aspect the invention includes a quick disconnect hinge assembly that is used as part of the easel apparatus or separately in any shelf system.

BRIEF DESCRIPTIONS OF THE DRAWINGS

Various other features and attendant advantages of the present invention will be more fully appreciated as the same becomes better understood when considered in conjunction with the accompanying drawings, in which like reference characters designate the same or similar parts throughout the several views, and wherein.

DETAILED DESCRIPTION OF ALTERNATIVE EMBODIMENTS OF THE INVENTION

Figure 1:
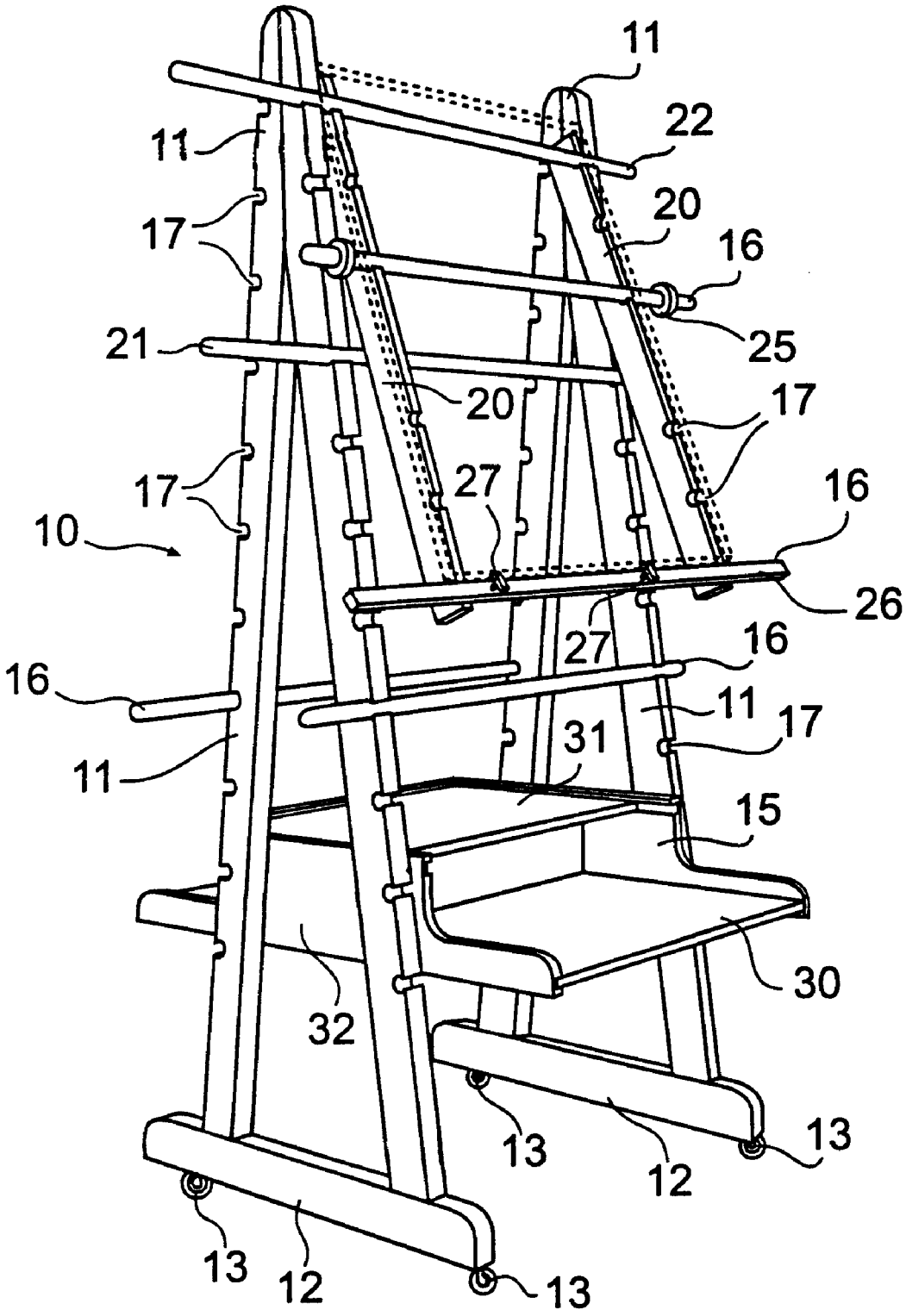
FIG. 1 is a perspective view of one embodiment of an easel in accordance with the present invention.

The present invention incorporates many components and many different combinations of those components. Although many of these combinations are incorporated in the drawings that will be described, a person of ordinary skill in art can, of course, devise alternative combinations that incorporate the teachings of the present invention.

Figure 2:
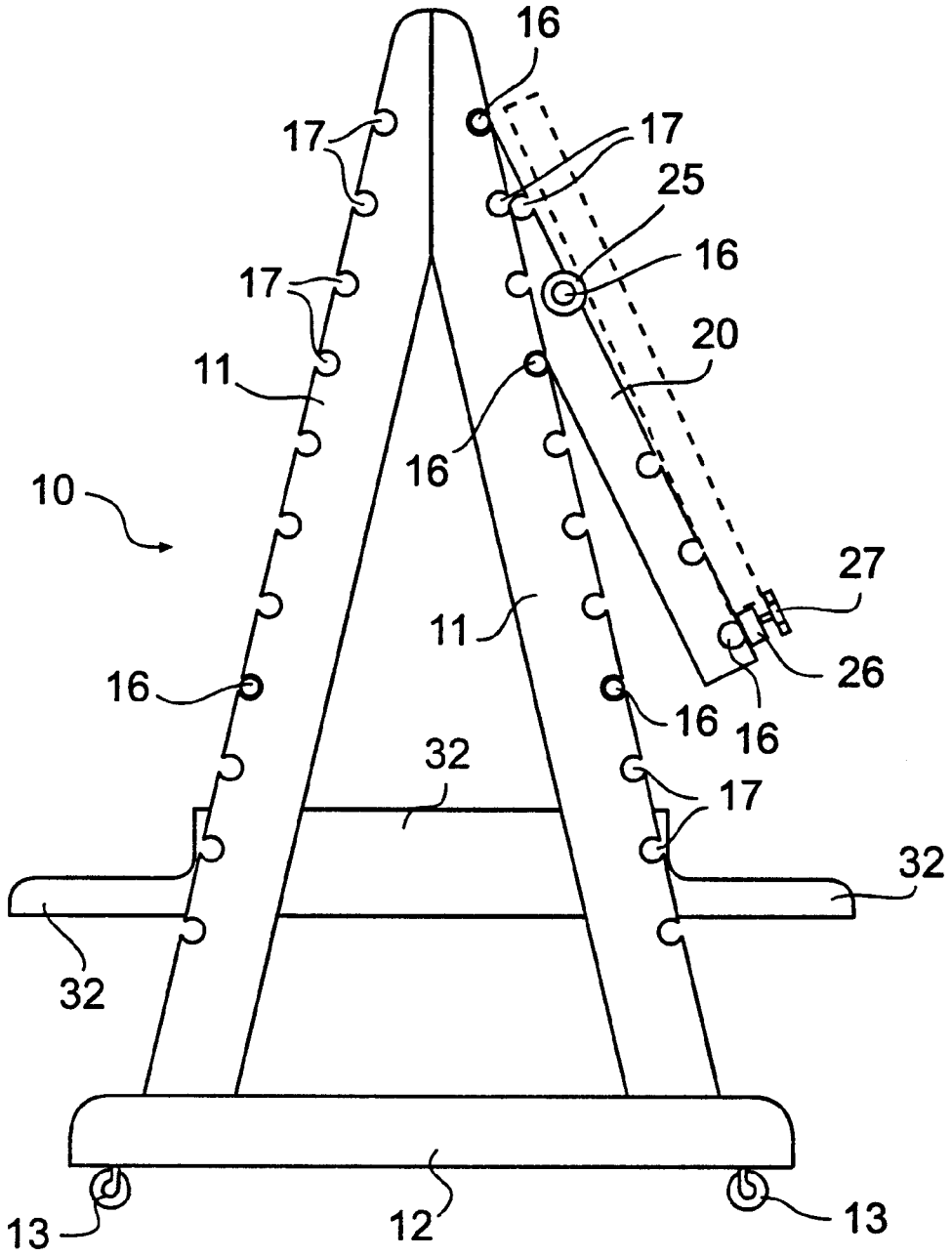
FIG. 2 is a side elevation of the easel shown in FIG. 1.

FIGS. 1 and 2 display an easel 10 that is made up of a pair of vertical A-frame supports 11. The bottom of each of the A-frame supports 11 is attached to a base 12 that is carried on wheels 13. The wheels 13 may be caster wheels or any other type of wheel including a wheel that has a brake or lock to fix the easel in place and make it immovable. Alternatively, the easel 10 may have no wheels at all. The outside edges of the vertical A-frame supports 11 have holes 17 along their length. The holes 17 have horizontal bores. In other words, the holes 17 have circular bores that are generally parallel to the ground. Each of the bores along the edge of the A-frame supports 11 is open to the out side edge. Rods 16 are shown in various positions in the easel 10. The rods are round and are adapted to fit within the circular bore of the holes 17 as shown.

The vertical A-frame supports 11 are connected to each other by the horizontal shelf 15. The shelf 15 is made up of a top surface 31, a bottom surface 30 and side panels 32. The side panels 32 are fixedly attached to the vertical supports 11 thereby providing integrity and stability to the entire easel 10. Many types and shapes of shelves and supply bins, including those shown and described herein, could be used. The horizontal support rods 16 further support and contribute to the stability of the easel 10. The holes 17 as shown have corresponding, parallel holes in each of the vertical supports 11 In this way, the horizontal support rods 16 may pass through holes 17 in each of the vertical supports.

There is also shown in FIGS. 1 and 2 a pair of tilt supports 20 that, together with horizontal support rods 16, form a variable tilt platform onto which an artistic substrate such as a canvas can be mounted. A canvas is shown in dotted lines in FIGS. 1 and 2. The tilt supports 20 have holes 17 effectively identical to the holes 17 discussed earlier. Rod 21 is identical to the other horizontal support rods 16. However, rod 21 does not pass through any holes 17 in the tilt supports 20. Instead, rod 21 passes through holes 17 in the vertical support members 11 only. The tilt supports 20 rest on the rod 21 yet are secured to the A-frame vertical supports 11 by rod 22. Rod 22 is similarly identical to the horizontal support rods 16 also shown. Rod 21 may be inserted into other holes 17 along the vertical length of the A-frame vertical member 11 in order to vary the degree of tilt in the tilt supports 20. Similarly, the rod 22 may be placed in any of the holes 17 along the vertical length of the vertical members 11 thereby varying the height of the tilt supports 20. As is evident from the foregoing, the height and degree of tilt of the tilt supports 20 can be adjusted to the preference of a user.

One of the rods 16 has locking collars 25 on it. (See also FIG. 6). These collars 25 prevent the rod 16 from sliding out of the holes 17. Devices similar to the locking collar 25 may be used in connection with any of the rods 16 to secure a rod in place in the easel 10. Another rod 16 has a ledge 26 secured to it. The ledge 26 is a flat strip that is screwed or glued or otherwise attached to a rod 16 and has a width no greater than the opening of the holes 16 on the side edge. In this way, a rod 16 with a ledge 26 may still slide in and out of the holes 17. There is also shown a T-clip 27 that is an alternative holder for securing, for instance, a paint canvas on the easel. The T-clip 27 is also shown in FIG. 7. Other types of holders like the ledge 26 or T-clip 27 can be used in connection with a rod 16 to secure an artistic substrate to an easel. Various types of buttons or clips or tacks may be used. Alternatively, the ledge 26 may have a greater thickness and itself be the ledge that holds an artistic substrate like a canvas in place on the easel.

The holes 17 described in connection with preferred embodiments of the invention have round cross sections for the primary purposes of convenience, availability and ease of use. The important feature of the cross-sectional shape is that it be adapted to receive an horizontal rod 16. Also the placement of the holes 17 along the edges of the supports 11 allows the holes to be open to the side edge. For instance, if two rods 16 in combination with a holding means like a T-clip 27 are carrying and supporting a paint canvas, the rods (and canvas) may be removed from the easel 10 and set aside for drying or storage without having to remove the T-clips or the canvas. Different rods 16 could then be inserted into the easel 10 to support a different canvas or other artistic substrate. Other shaped rods and cross-sections of holes may be used in accordance with the teachings of the present invention. Also, the holes 17 may alternatively be completely within the support 11 and not open to a side edge.

Also, FIGS. 1 and 2 inherently demonstrate that the easel 10 may be used by more than one person. Canvases, for instance, can be placed on each side of the easel 10. Also, three or more vertical supports 11 can be connected together to effectively from a row of easel stations that could be desirable for a studio or classroom, for instance. In each variation, the teachings of the present invention may be used to create customized graphic arts stations.

Figure 3:
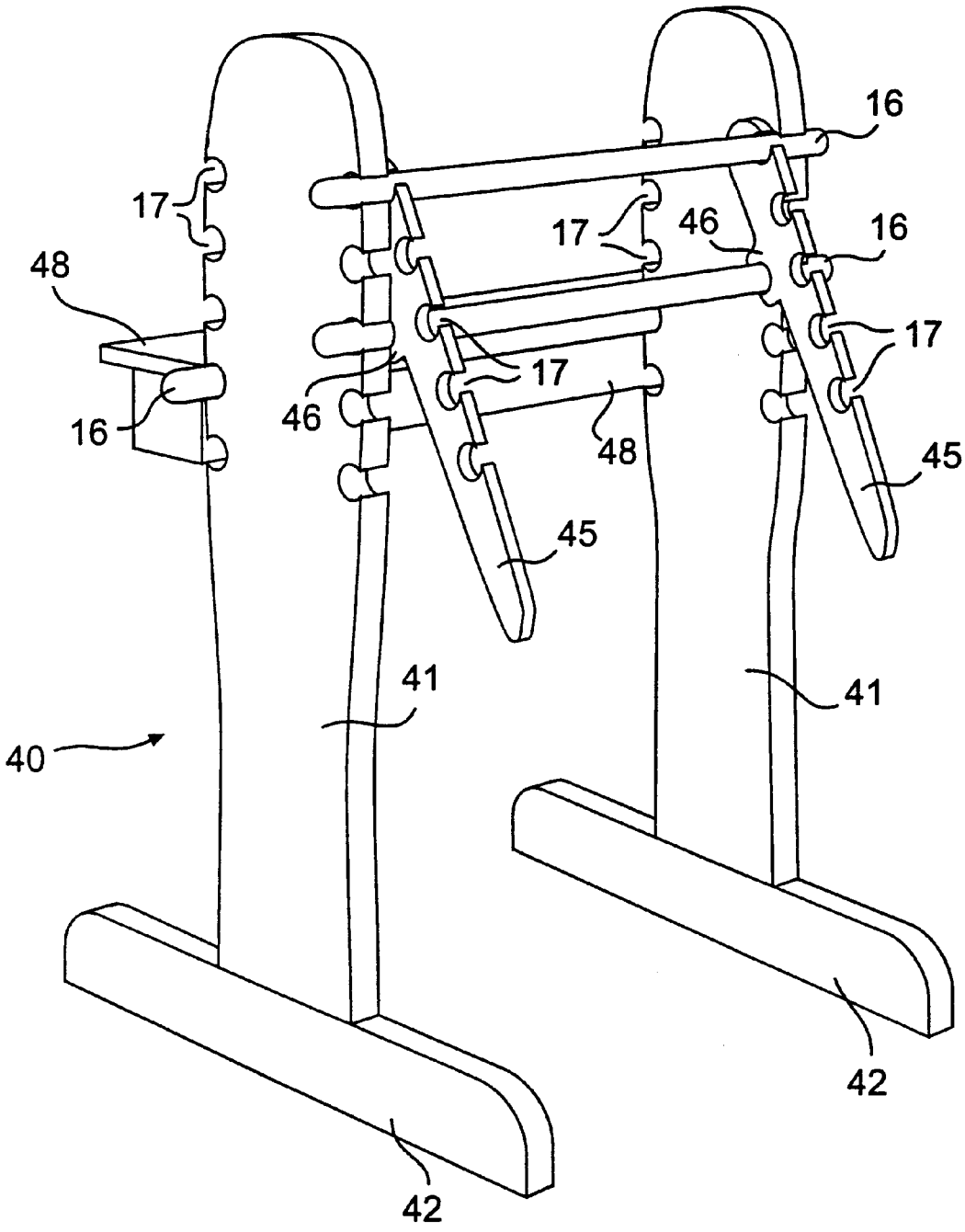
FIG. 3 is a perspective view of an alternative embodiment of an easel according to the present invention.

FIG. 3 illustrates an alternative embodiment of an easel 40 in accordance with the present invention. The easel 40 vertical supports 41 are fixedly mounted onto bases 42. The bases 42 may or may not have wheels attached to them to allow the easel 40 to be moved about. The vertical supports 41 are connected to each other by the horizontal support rods 16 that extend through holes 17 into the vertical supports 41.

Tilt supports 45 are also shown. The tilt supports 45 also have holes 17 into which rods 16 may be inserted. The tilt supports 45 have arms 46 that make up a portion of the tilt support. The arms 46 also have holes through which support rods 16 may be inserted. As shown, a support rod 16 may be inserted into the arm 46 of the tilt support 45. Alternatively, the tilt support 45 may rest on a rod 16 that is not inserted through the arm 46, rather it would pass through other holes 17 on the vertical support 41. In this way, the angle of tilt of the tilt support 45 can be adjusted. Further alternatively, the arm 46 may have several holes 17 in it that would allow a rod 16 to be inserted through them. In this way, the relative tilt could also be adjusted. (See FIG. 8).

Also shown in FIG. 3 is one embodiment of a shelf 48 that is attached to the vertical supports 41 by passing a rod 16 through a hole 17 and through a hole (not shown) in the shelf 48. In this way, the height of the shelf 48 may be adjusted at the preference of the user by merely inserting the rod 16 into any of the preferred holes 17.

Figure 4:
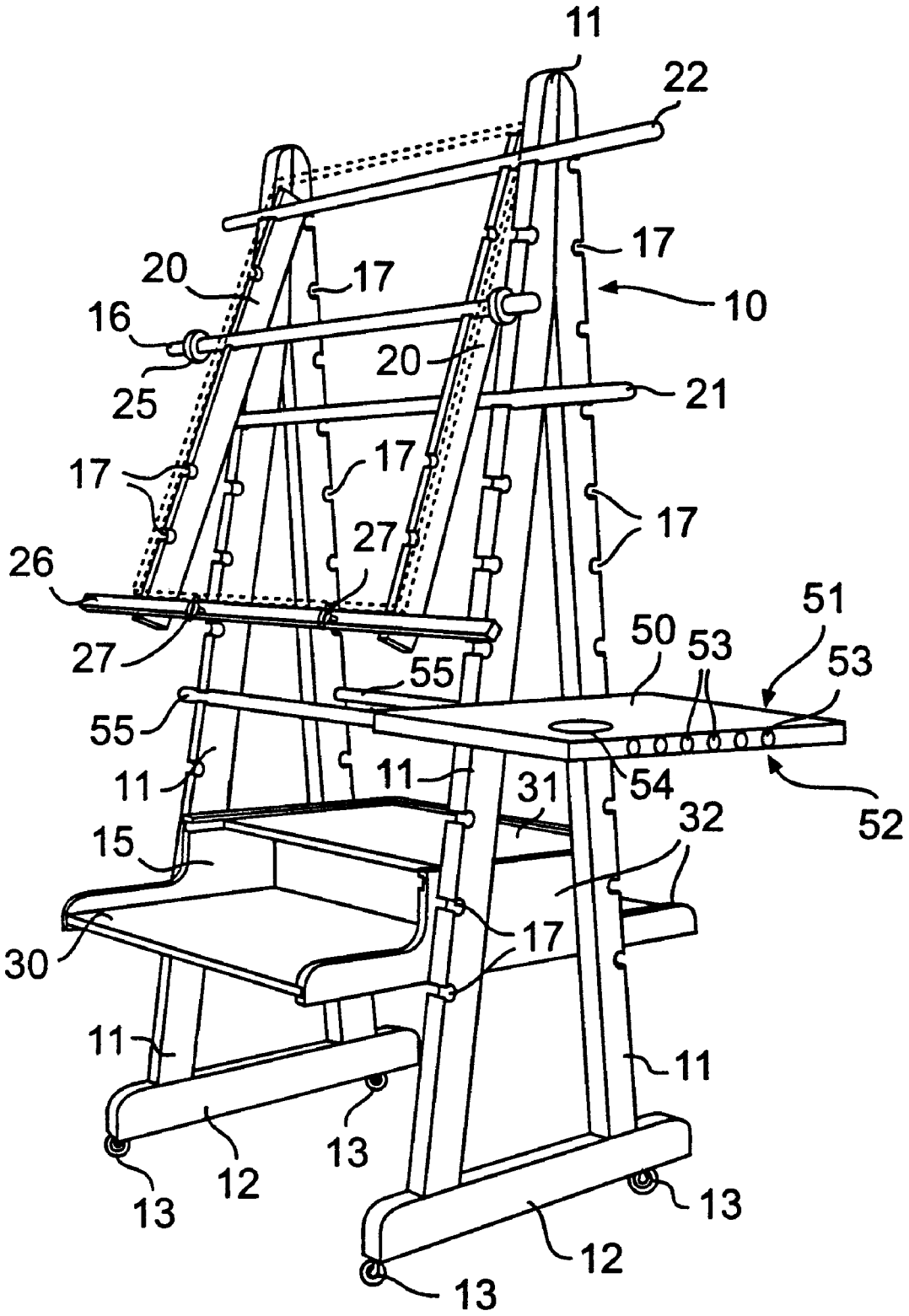
FIG. 4 is a perspective view of an easel in accordance with the present invention and further comprising a swivel panel in the horizontal position.
Figure 5:
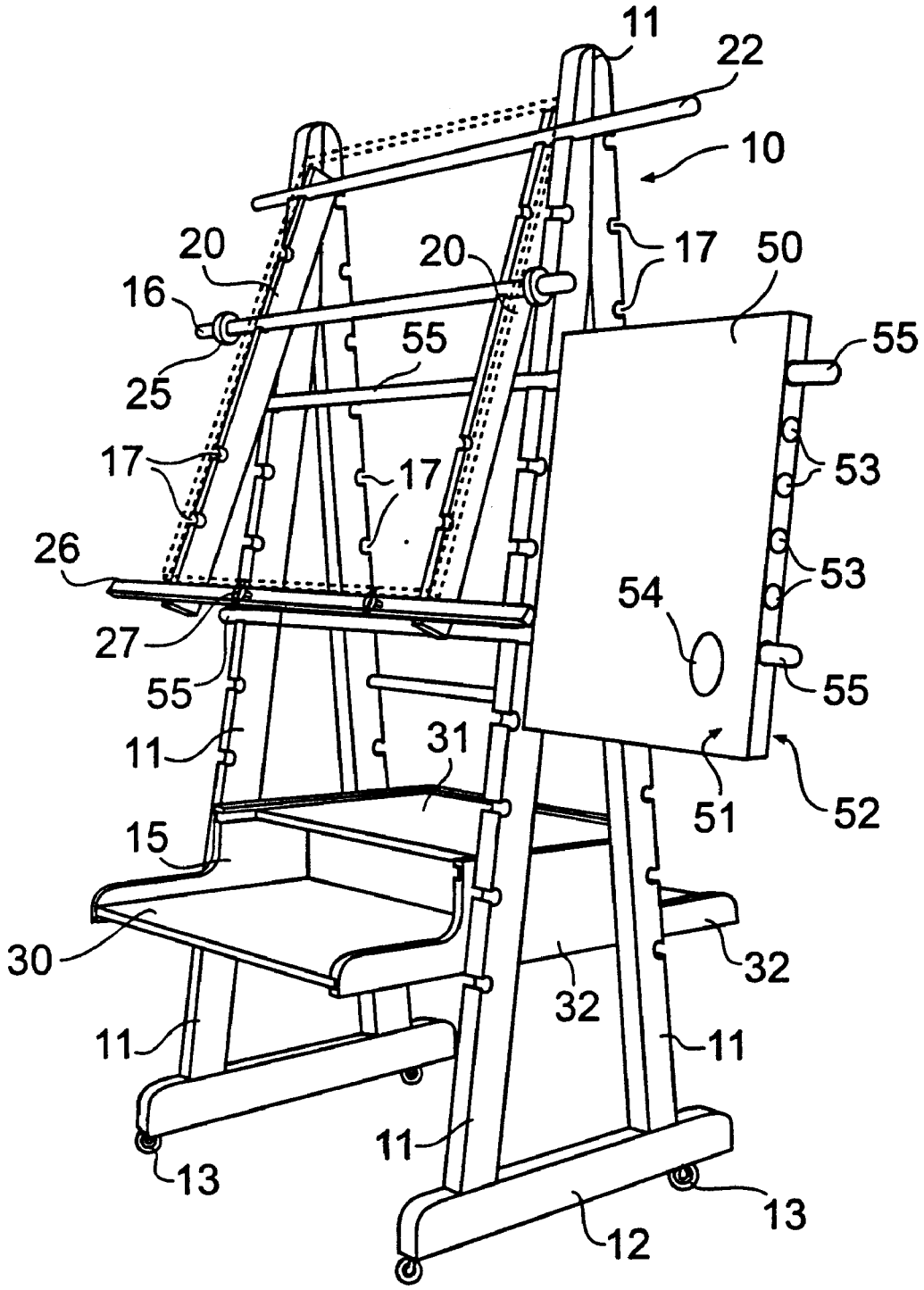
FIG. 5 is a perspective view of an easel in accordance with the present invention and further comprising a swivel panel in the upright position.

FIGS. 4 and 5 illustrate the easel 10 that has been described in connection with FIGS. 1 and 2. FIG. 4 further illustrates a swivel panel 50. The swivel panel 50 has a first side 51 and a second side 52. The panel 50 also has holes 53 that are in the cross sectional width of the panel. The holes 53 are adapted to receive rods 55. Rods 55 are the same as the horizontal support rods 16 discussed earlier and also shown in FIG. 4. The holes 53 may extend all the way through the panel 50. Alternatively, the holes 53 may only extend partially into the panel 50. In any event, the holes 53 must have bores that are open on at least one side of the panel 50 to allow insertion of rods 55. The swivel panel 50 is mounted in the horizontal position in FIG. 4. In other words, the rods 55 are inserted through holes 17 that are parallel to each other and with respect to a floor surface. Alternatively, as illustrated in FIG. 5, the swivel panel 50 may be mounted in an upright position where the rods 55 are inserted into the same edge of a horizontal support member 11. Obviously, variations in the degree of tilt may be obtained by inserting the panel 50 onto rods 55 that can be placed in various different holes 17. The height of the panel 50 can also be varied accordingly. Preferably, the panel 50 has a first side 51 that is comprised of a hard material such a formica or hardwood. The second side 52 of the panel 50 is preferably comprised of a cork or balsa wood surface to allow thumb tacks or similar fasteners to be stuck into this surface. In this way, for instance, when the panel 50 is in the upright position (FIG. 5) a photograph or sketch may be tacked to the swivel panel for easy reference by a person using the easel 10. Similarly, in the horizontal position (FIG. 4) the swivel panel 50 may be used as a work surface for mixing paints. An ink well 54 (or cup holder) may be similarly used and incorporated into the panel 50.

Figure 6:
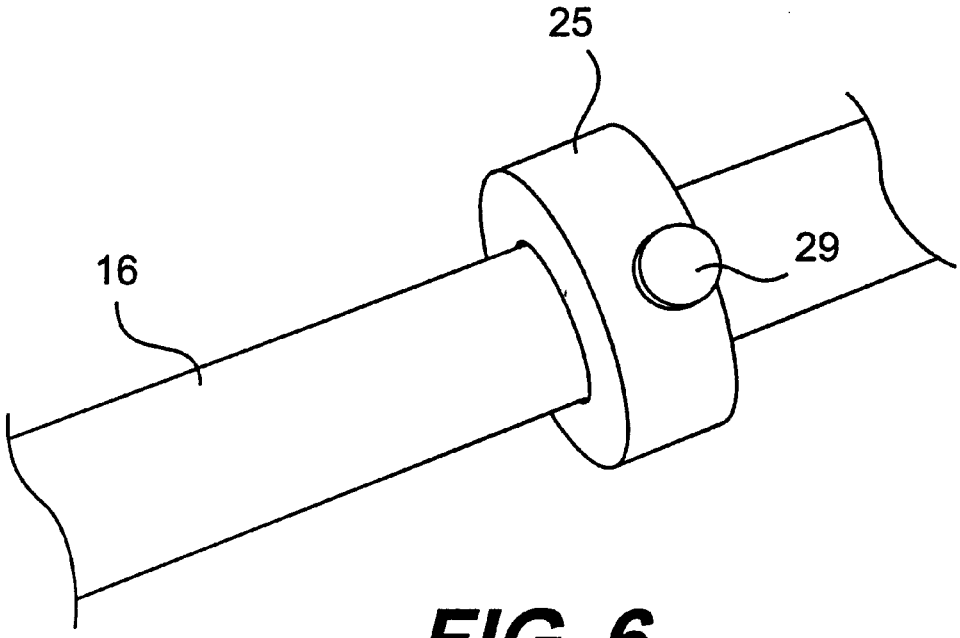
FIGS. 6 and 7 are partial views of alternative embodiments of rods in accordance with the present invention.
Figure 7:
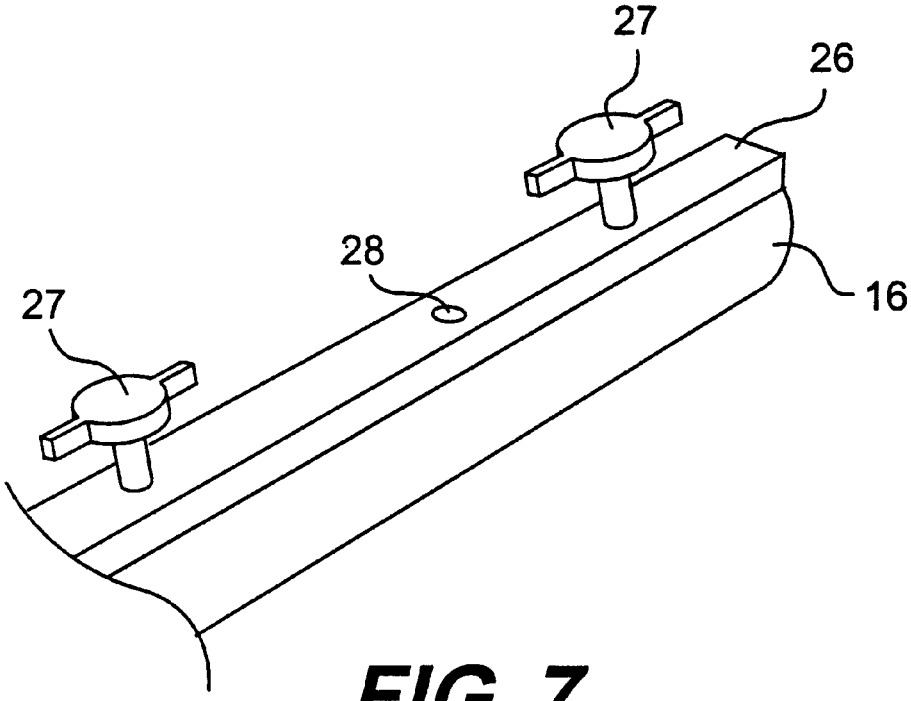

FIGS. 6 and 7 display alternative embodiments of attachments or components that may be attached to the horizontal supporting rods 16. In FIG. 6, the rod 16 has a locking collar 25 mounted around it. The collar 25 is attached to the rods 16 by means of a screw 29. In this way, the collar can be removed by loosening the screw 29. Alternatively, the collar can be moved up and down the length of the rod 16. FIG. 7 shows a rod 16 having a ledge 26 attached to it. The ledge 26 may be in the form of a narrow strip as illustrated. Alternatively, the ledge may be much thicker and protrude out much further to form a ledge on which to rest, for instance, a paint canvas. The ledge 26 is secured to the rod 16 by a screw 28. T-clip 27 are screwed into the ledge 25. The T-clips 27 may be turned and oriented so that the T-clip will secure a painting in place. Alternatively, they may form a base unto which a paint canvas may rest. Other types of holding means in addition to the T-clips 27 and ledge 26 include attaching tacks or other latches directly to a rod 16. Many other variable types of holding means are known to those of skill in the art.

Figure 8:
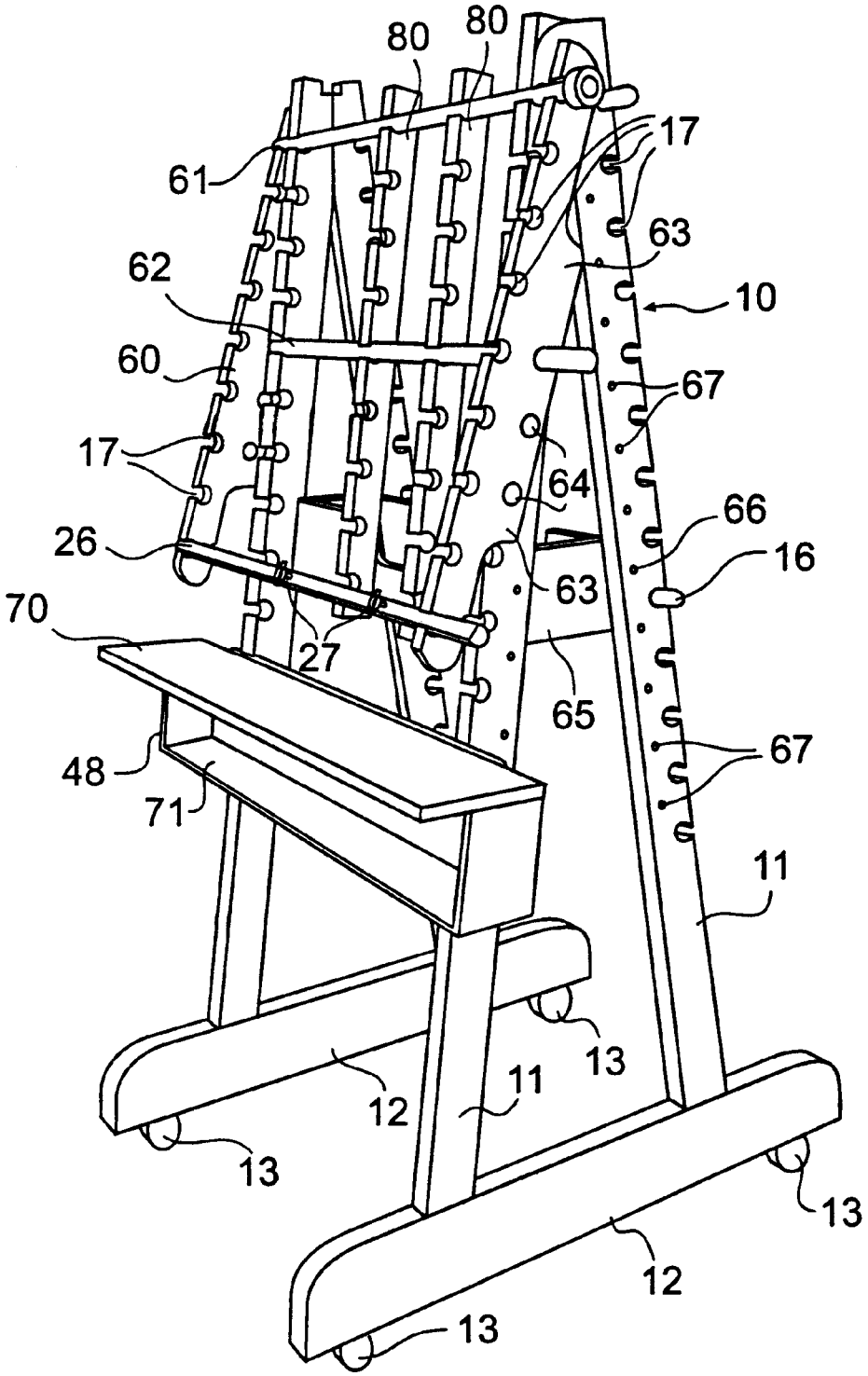
FIG. 8 is a perspective view of an easel in accordance with the present invention including a variable tilt platform.
Figure 9:
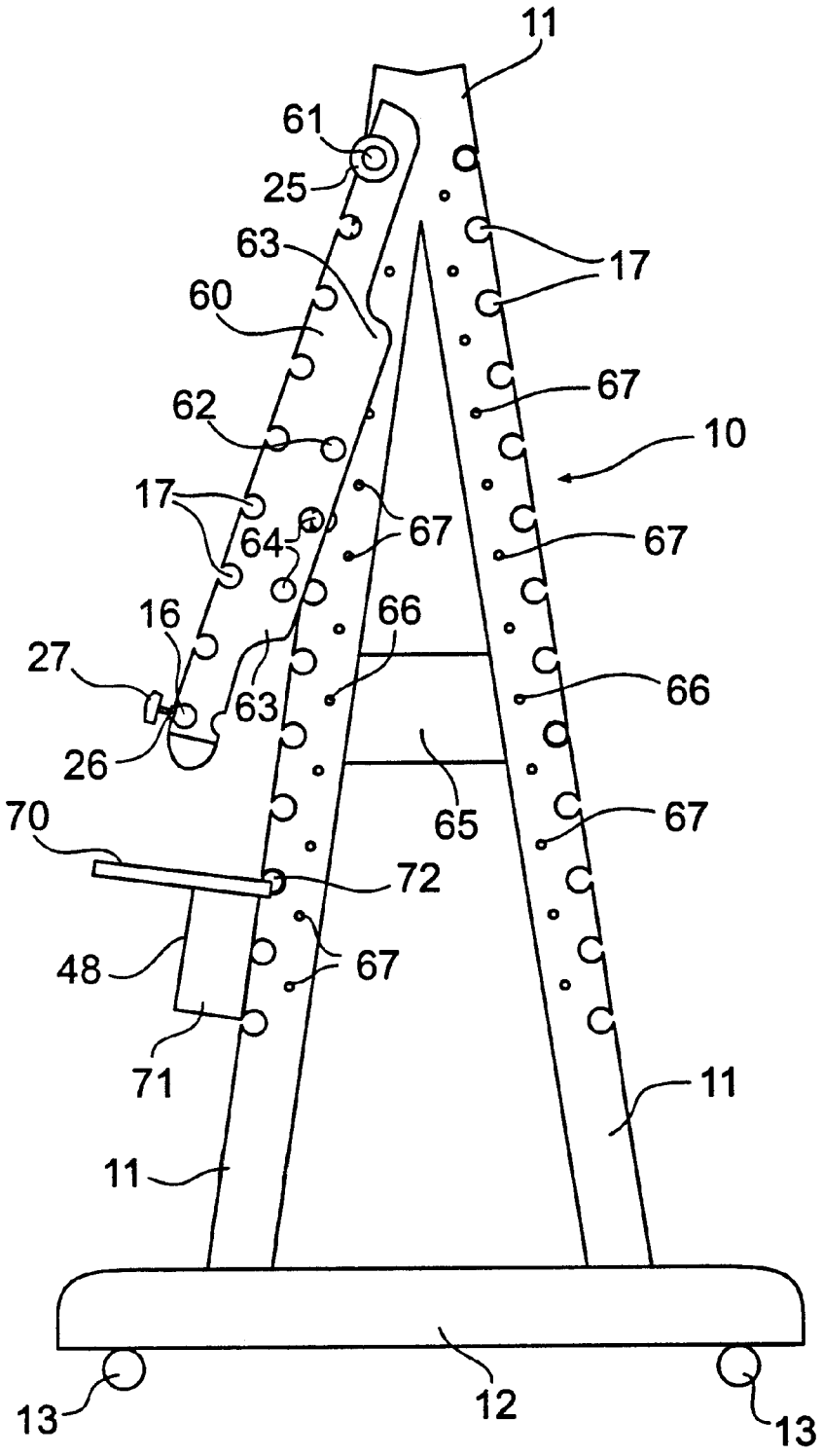
FIG. 9 is a side elevation view of the easel shown in FIG. 8.
Figure 15:
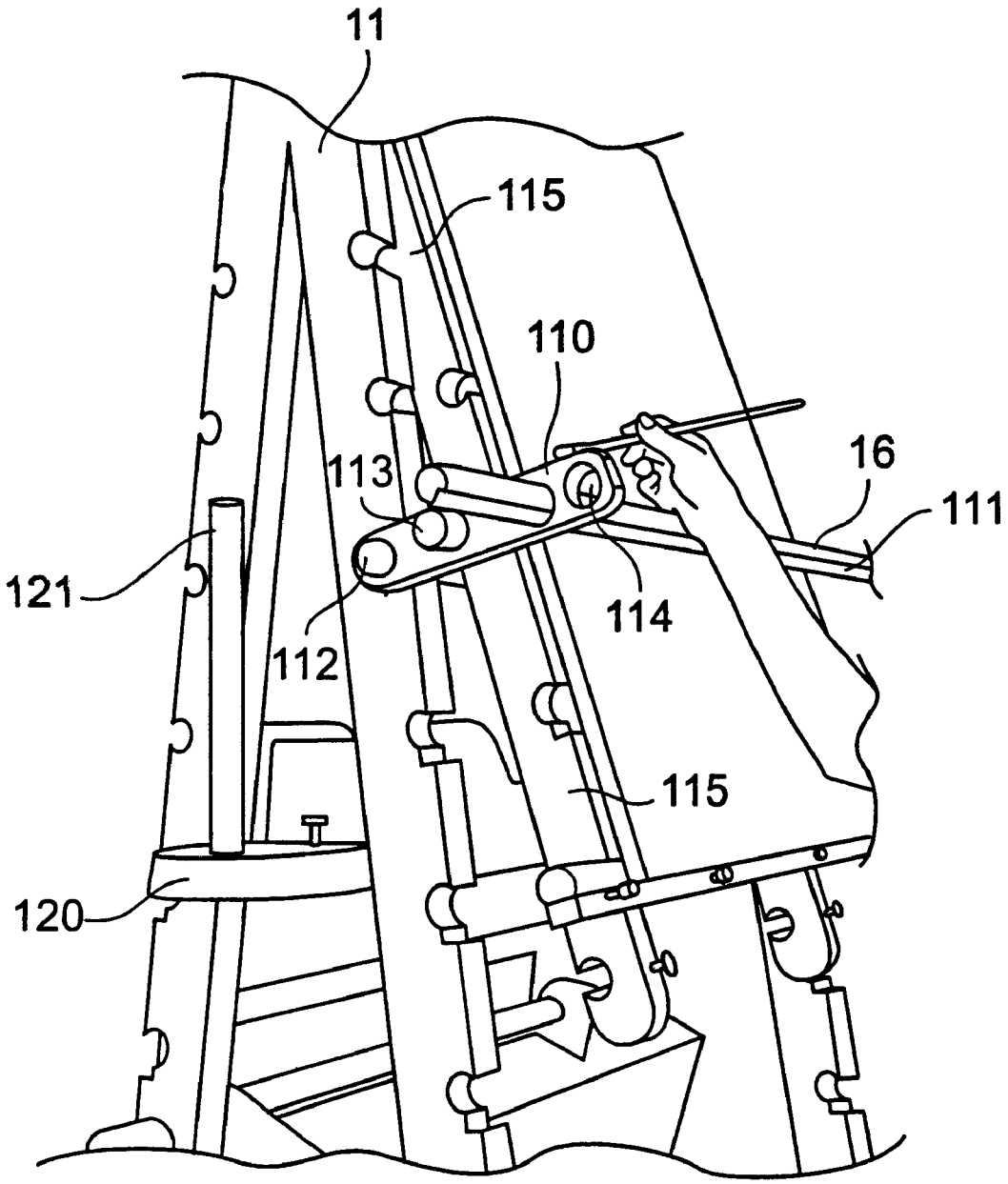
FIG. 15 is a partial perspective of an easel in accordance with the present invention further displaying a hand rest bar.
Figure 15A:
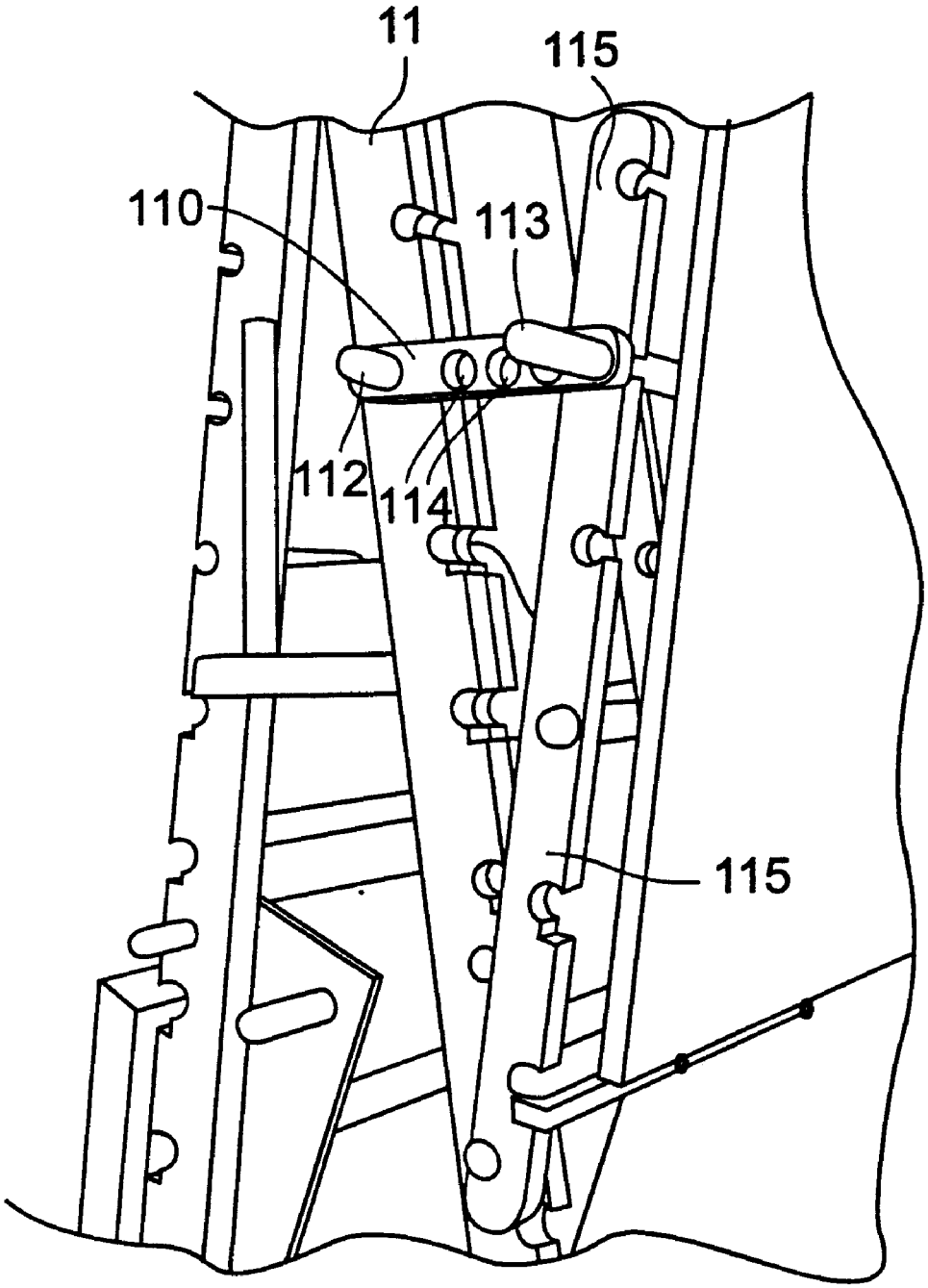
FIG. 15A is a partial view of an alternative, variable tilt platform assembly.

FIGS. 8 and 9 illustrate a further alternative combination of components to make up an easel 10. In these figures, a different type to tilt support 60 is connected to the easel 10 by inserting rod 61 through holes 17 in the vertical support members 11. The tilt support 60 is further connected to easel 10 by inserting rod 62 through holes 17 and through holes 64 that are situated in the arm 63 of the tilt support 60. The arm 63 is integral with the tilt support 60. Alternatively, as shown in FIGS. 15 and 15A, an arm may be an entirely separate component from a tilt support. As is evident from the drawings, the arm 63 has several different holes 64 into which rods may be inserted. By selecting different holes 64, the angle of the tilt of the tilt support 60 can be adjusted. As in the earlier embodiments, the height of the tilt support 60 may also be varied by connecting the tilt support 60 in different holes 17 along the length of the vertical supports 11.

FIGS. 8 and 9 also display an alternative type of shelf 65 that is attached to the A-frame vertical supports 11 by screws in screw holes 66. Other screw holes 67 are placed up and down the height of the vertical supports 11 to allow a user to vary the height of the shelf 65. In addition to shelf 65, there is illustrated another shelf 48 comprised of a top ledge 70 and a storage space 71. This shelf 48 is attached to the vertical supports 11 by means of rod 72 that is inserted through holes 17 on the A-frame vertical supports.

Figure 10:
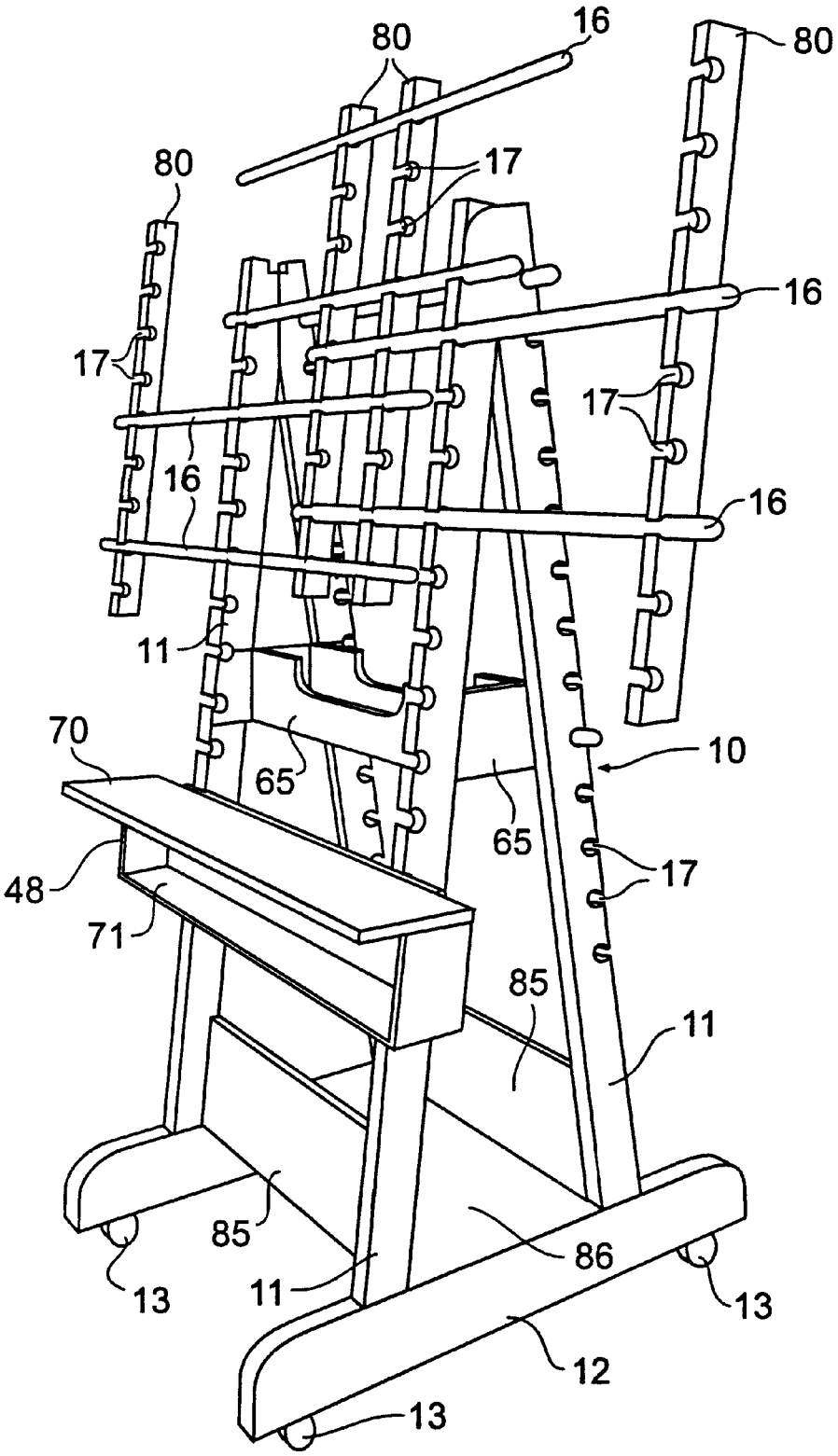
FIG. 10 is a perspective view of an easel in accordance with the present invention further including extension members and alternative types of ledges and bins.

FIG. 10 illustrates the easel 10 including extension members 80. The extension members 80 are merely supports having holes 17 identical to the holes 17 that are part of the vertical supports 11. Support rods 16 extend at least in part through a vertical support 11 and through an extension members 80 thereby connecting the extension members to the easel apparatus as a whole. The extension members 80 may be used to widen the easel as well as to increase the height of the easel as seen in FIG. 10. One or more extension members 80 may be used to expand the potential platforms for holding an artistic substrate such as a canvas. Potential combinations are limited only by the imagination of the user putting together a system to meet their needs.

The other component illustrated in FIG. 10 is a canvas storage bin area made up of a flat sheet 86 and two vertical walls 85. The walls 85 and flat piece 86 are fixed to the vertical supports 11 and better brace and make the entire easel 10 a solid unit.

Figure 11:
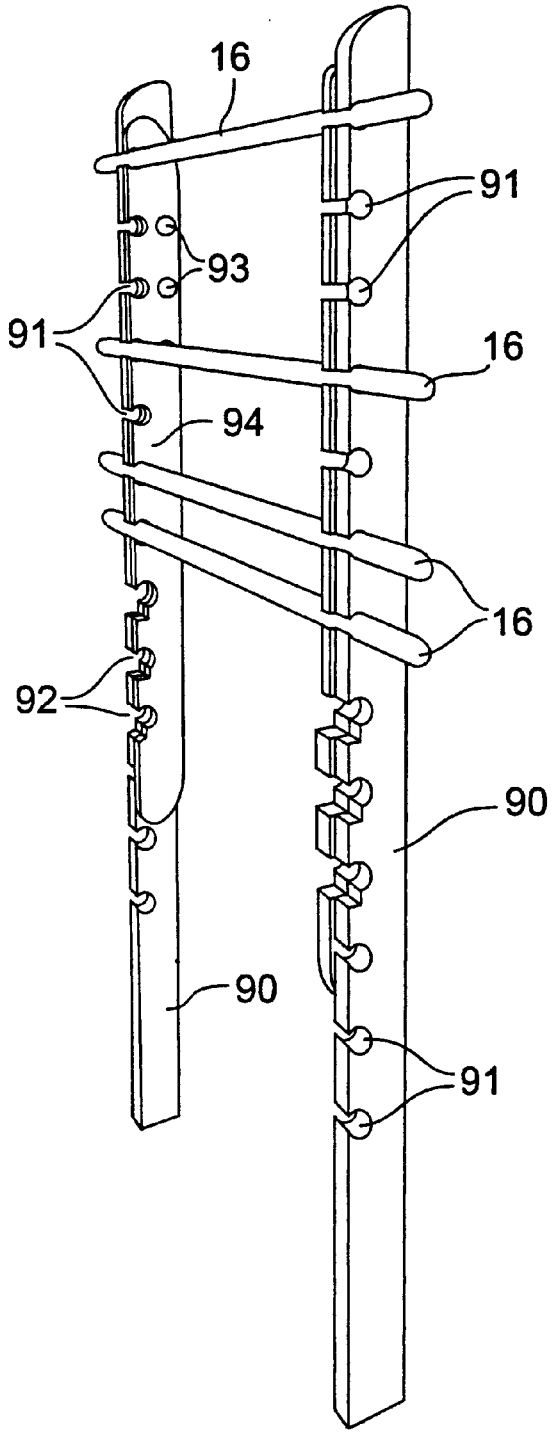
FIG. 11 is a perspective view of a wall mounted easel in accordance with one embodiment of present invention.
Figure 12:
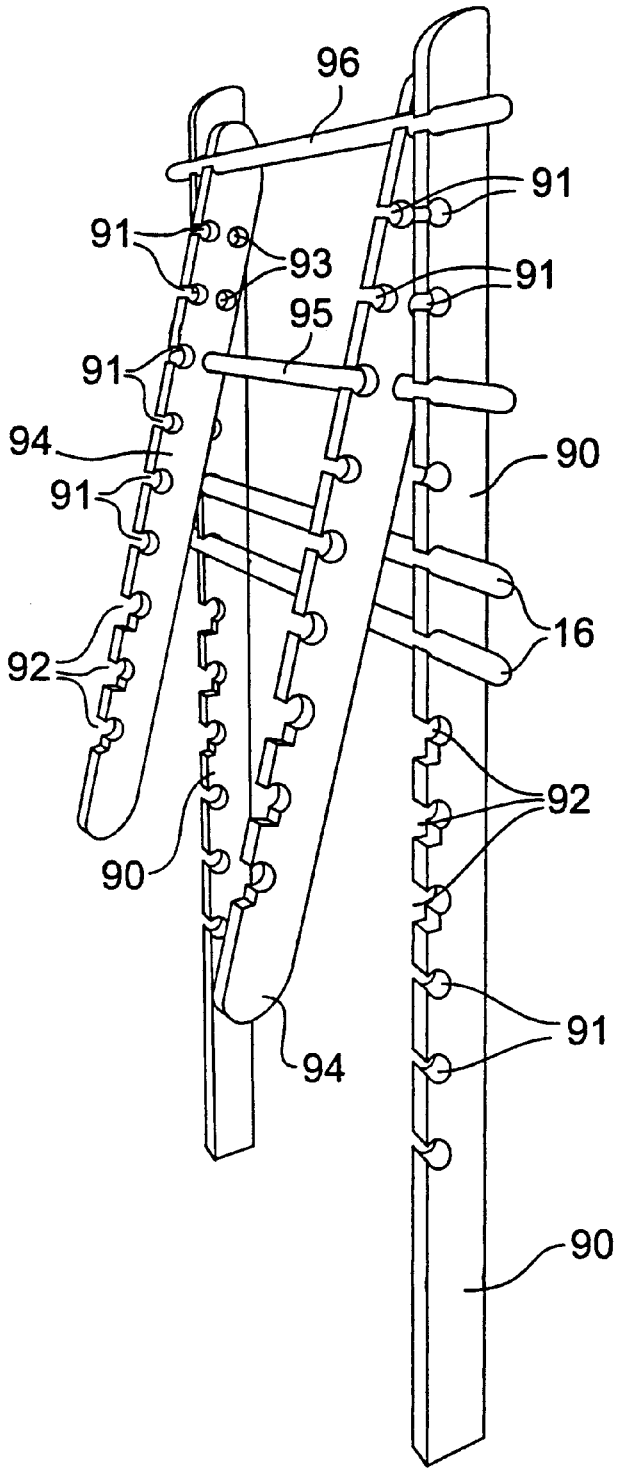
FIG. 12 is a perspective view of the wall mounted easel shown in FIG. 11 except that the variable tilt platform is not flush with the vertical members of the easel.

FIGS. 11 and 12 illustrate a wall mounted version of a graphic arts station. This apparatus includes vertical mounts 90 attached on one side to a wall. The vertical members 90 have holes 91 and 92 in them on the opposite side from the side attached to the wall. The holes 91 and 92 are different in that the cross sectional bore of the holes 91 is circular while the cross section of the bore of holes 92 is a partial key hole shape. The holes 91 and 92 are adapted to receive rods 16. The vertical members 90 are attached to a wall or door or other fixed object.

The tilt members 94 have holes 91 and 92 virtually identical to the holes 91 and 92 described above on the vertical members 90. The tilt member 94 additionally has holes 93 that are adapted to receive a support rod 16. As demonstrated in FIG. 12, rod 96 which is identical to the rods 16 in other drawings is inserted through holes in the vertical member 90 and the tilt member 94. The tilt member 94 rotates around the rod 96. The angle of the tilt is fixed by a second rod 95 that is also similar in construction to the rods 16 described throughout. The rod 95 passes through the vertical member 90 as well as one of the holes 93 in the tilt member 94. Because the holes 93 are not in a straight line along the edge with the holes 91 and 92, the tilt members 94 are at an angle to vertical members 90. The degree of tilt and the height of the tilt can be adjusted by inserting rods 95 and 96 through different holes 91 and 92 in the vertical members 90 and in tilt members 94.

Figure 13:
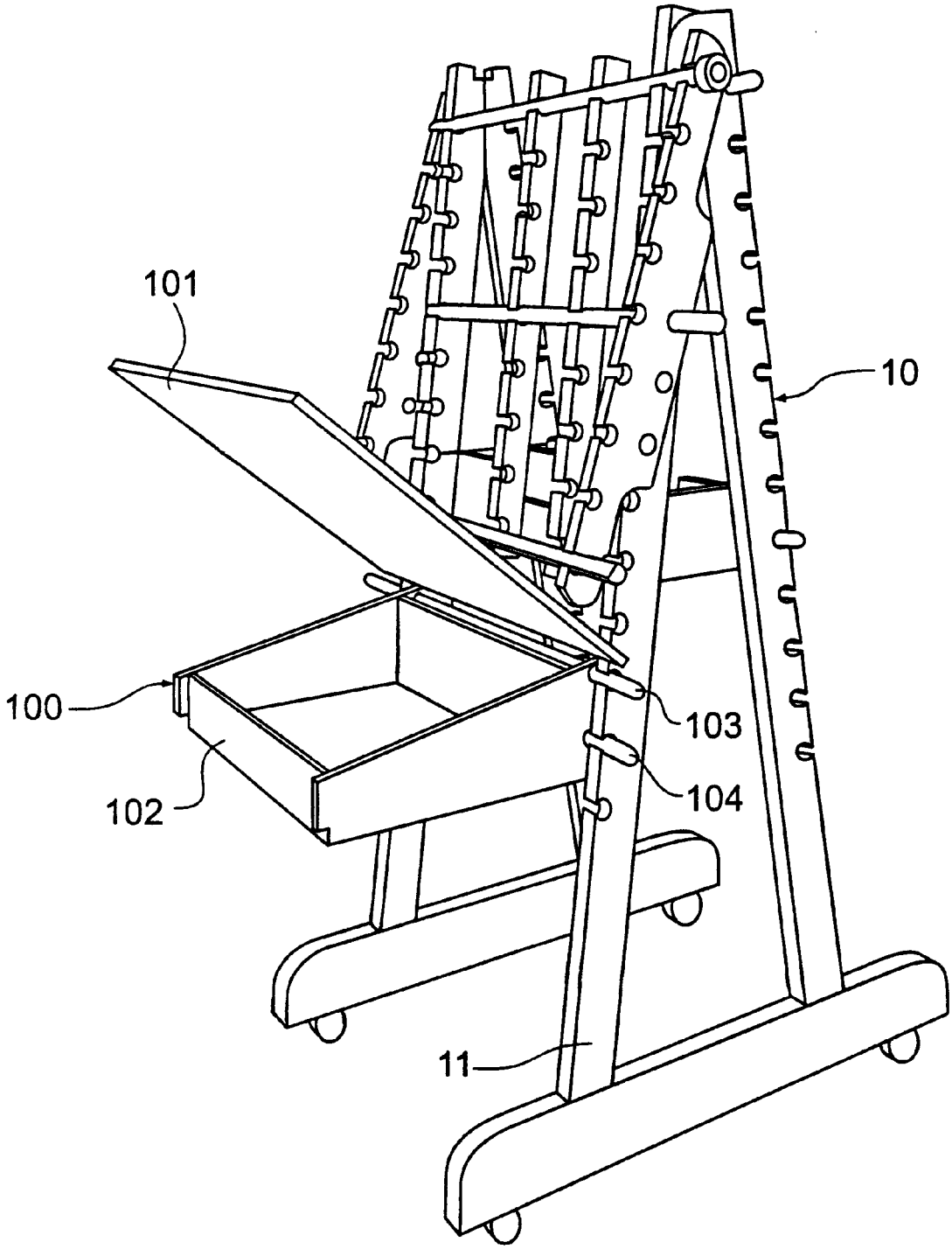
FIG. 13 is a perspective view of an easel in accordance with the present invention with the easel further including a desk attachment in the open position.
Figure 14:
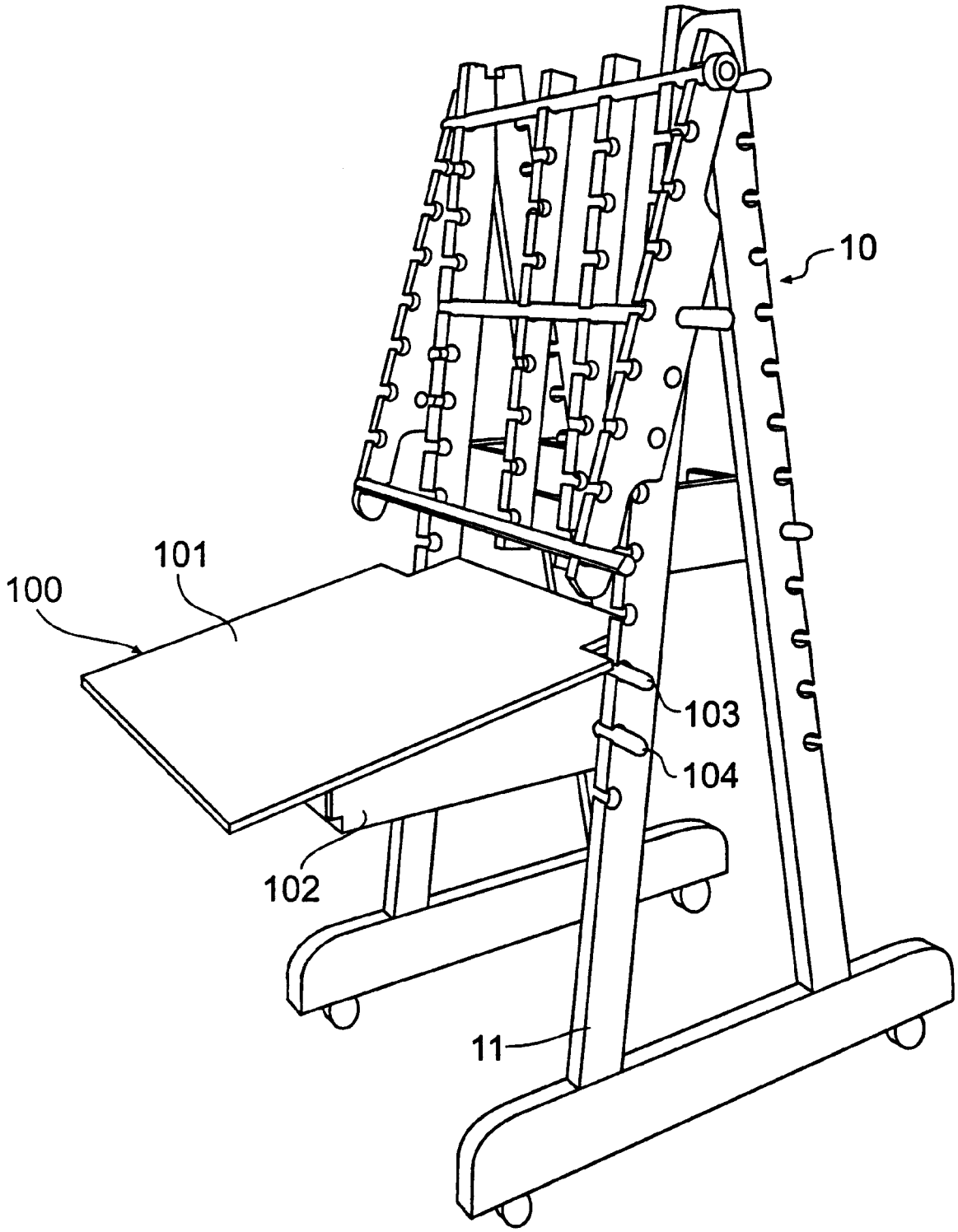
FIG. 14 is the same assembly as in FIG. 13 except that the desk portion is in the closed position.
Figure 14A:
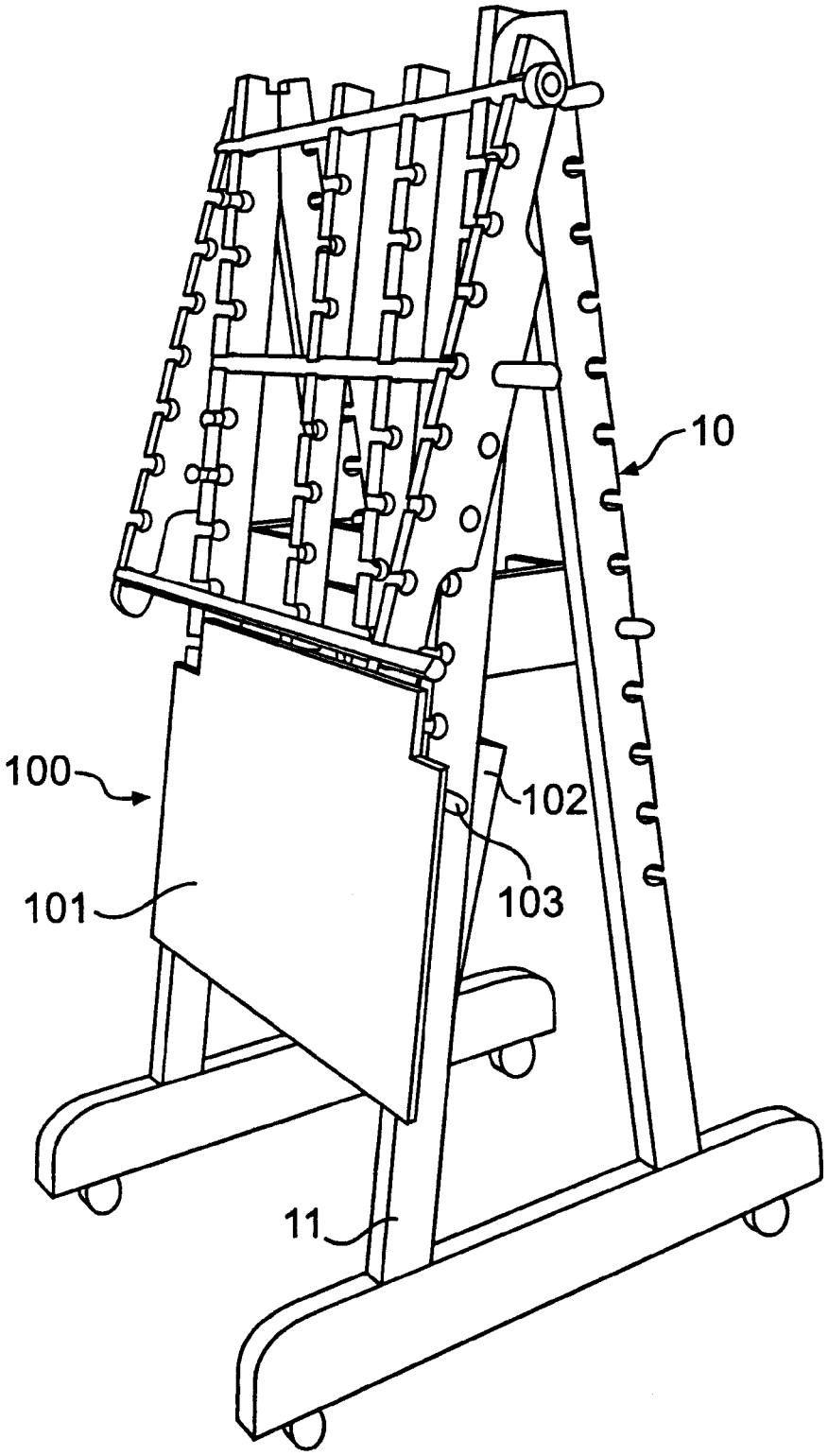
FIG. 14A is the same assembly as FIG. 13 except that the desk position is in the stored position.

FIGS. 13, 14 and 14A illustrate various positions for a desk component 100. In FIG. 13, desk component 100 includes a top 101 and storage bin 102. The desk 100 is attached to the vertical supports 11 of the easel 10. FIG. 14, the top 101 of the desk component 100 is in the down position. In FIG. 14A, the desk component 100 is in its stored position. The bin portion 102 has holes (not shown) through which the rods 103 and 104 extend to carry the desk. In order to put the desk 100 in the packed position, the rod 104 is removed and the desk merely rotates about rod 103 down to the packed position. As with many of the components described herein, the height of the desk 100 may be adjusted according to the particular holes in the vertical supports 11 which rods 103 and 104 are inserted. Also, it is possible to conceive of different tilts of the desk 100 by using the various tilt members described in connection with this invention.

FIGS. 15 and 15A show partial views of an easel having a separate component arm 110 that is used to adjust the tilt of the tilt supports 115 so that the bottom of the tilt supports 115 is forward, (FIG. 15) or the top of the tilt supports 115 as forward (FIG. 15A). The arm 110 is a simple component comprising a plurality of holes 114. By combining the aim 110 with the tilt member 115 and the vertical supports 11, the tilt supports 115 can be attached on the bottom to the support 11 and tilted so that the top is forward as shown in 15A. Rod 112 and rod 113 are used in combination with the arm 110 to attach the tilt support to the vertical support 11. Another feature shown in FIG. 15 is a hand rest 111. This is simply a rod 16 that passes through a hole 114 in the arm 110 whereby the rod 16 is on the front of the artistic substrate, for instance a canvas. In this way, as illustrated, an artist can rest his or her hand on the rod 16 while he/she is painting in order to steady their hand or rest their hand. FIG. 15 also illustrates an additional feature where a ledge 120 may be attached to the vertical supports 11 and further have a paper towel holder 121. This may be particularly handy for clean up or for the painting process of a person using the easel.

Figure 16:
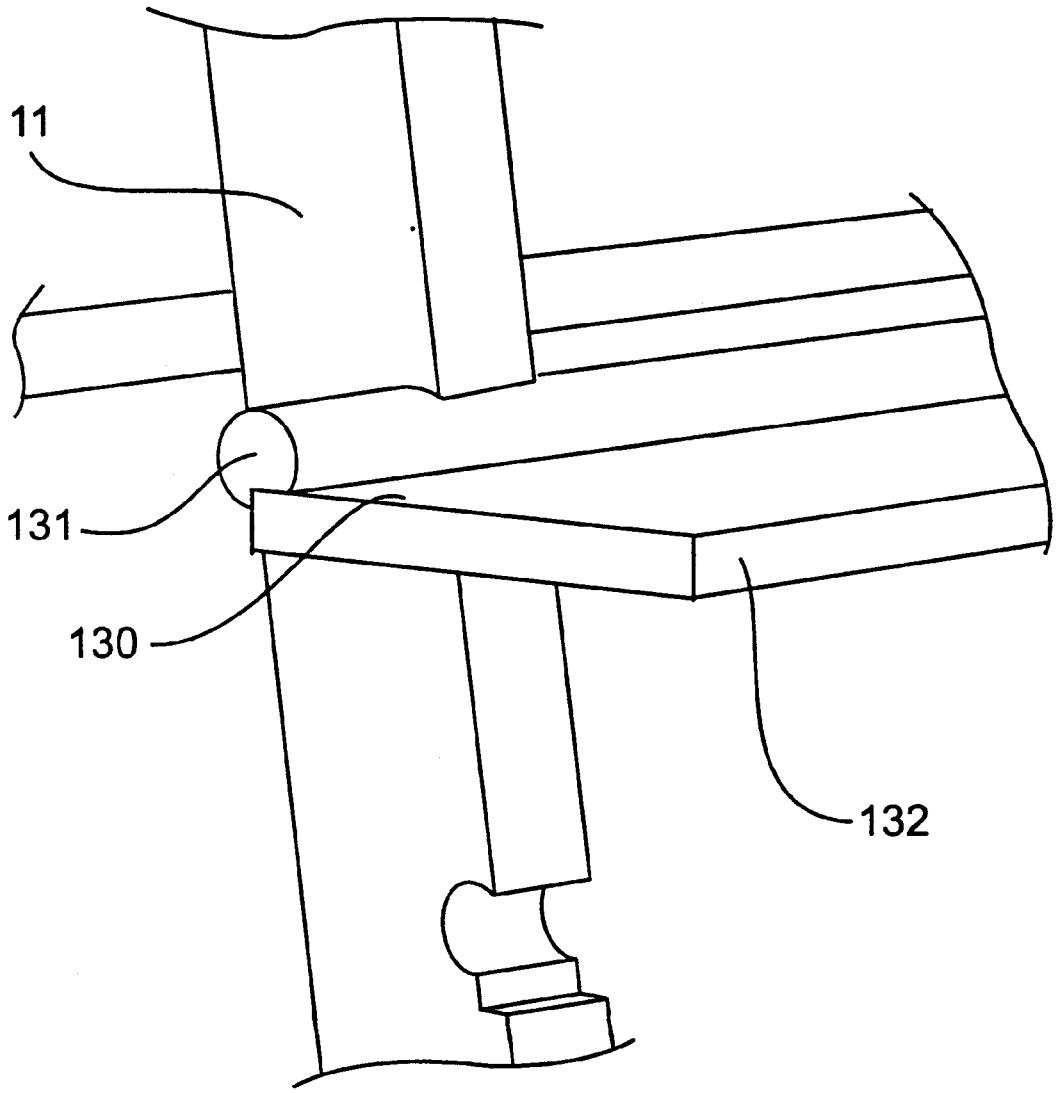
FIG. 16 is a perspective view of an easel in accordance with the present invention and further including a quick disconnect hinge.
Figure 17:
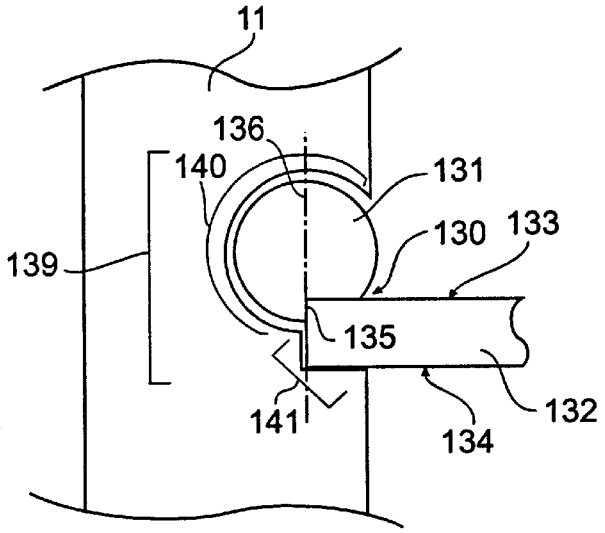
FIG. 17 is a side elevation view of a quick disconnect hinge assembly shown in FIG. 16.

FIG. 16 is a blown up view of a quick disconnect hinge assembly where shelf 132 and rod 131 make up the male portion 130 of a quick disconnect hinge. The particular quick disconnect hinge 130 shown in FIG. 16 is shown in a cross section elevation view in FIG. 17. As illustrated best in FIG. 17, the male component 130 rests within a channel 139 in the vertical support 11. The channel 139 is referred to in other drawings as a hole 17. It is discussed specifically here in connection with a quick disconnect hinge as a channel. The male portion 130 is comprised of a round rod 131 and a shelf 132. The shelf 132 has a top surface 133 and a bottom surface 134 and a side 135. The top surface 133 is attached to the rod 132 so that the side 135 extends outwardly from the diameter of the rod 131. As is evident in FIG. 17, shelf 132 is partially cut into the rod 131. All that is necessary is that there is some protrusion of the side 135 from the diameter of the rod 131. When the side 135 of the shelf 132 is squared or perpendicular to the bottom surface 134, then the side may not protrude from the diameter of the rod 131 further than a centerline 136 (dotted line) that is a line that passes through the center of the rod. If it is set further back, then the male portion 130 will not be insertable into or removable from the channel 139. Alternatively, if a side of the shelf 132 is angled (see FIG. 19, for instance), then the shelf can be set further back into the rod 131.

The channel 139 is the female component of the assembly and has two sectors. The first sector 140 is partially circular curve that has a length less than half of the diameter of the entire circle defined by the partially circular curve. The second sector has a concave shape and connects the bottom end of the first sector to the side of the female component or channel. The channel 139 is adapted to receive the male component 130. Therefore, the diameter of the circular curve of the first sector is at least the diameter of the rod portion of the male front portion 131 of the male component 130. In that way, the rod may be placed into and removed from the channel 139.

As shown in the figures, the male portion 130 has two different pieces—a round rod 131 and a shelf 132. It is alternatively possible that a male portion is a single piece of material. As illustrated, the joint assembly is made of wood. Plastic or metal materials may similarly be used for either or both of the male and female portions and subparts thereof.

Also, the quick disconnect hinge as illustrated in this application is described in the environment of an easel where the channel 139 of the female portion is a part of vertical support 11. The male portion 130 has a shelf 132 and may also include any storage bin, for instance like those described in various embodiments herein. The quick disconnect hinge, however, has a much broader application than simply an easel. It can be used with any types of shelves for household use or for book storage, etc.

Figure 18:
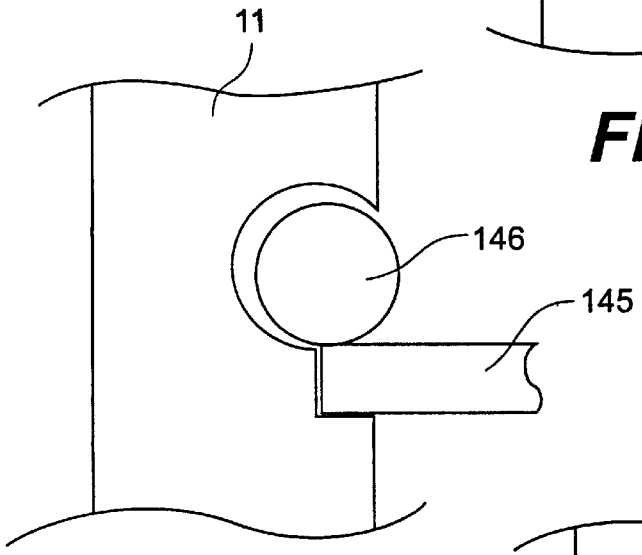
FIGS. 18 and 19 are side elevation views of alternative embodiments of the disconnect hinge assemblies.
Figure 19:
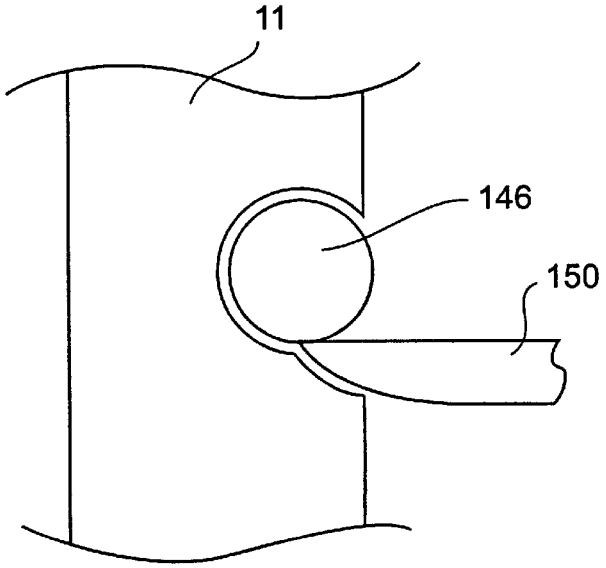

FIGS. 18 and 19 illustrate alternative embodiments of the quick disconnect hinge showing different types of rod and shelf assemblies. In FIG. 18, the shelf 145 is not extending in any way into the rod 146. Similarly, in FIG. 19, the shelf 150 does not extend into the rod 146. It does, as noted earlier, extend outwardly from the diameter of the rod 146. The shape of the shelf in combination with the rod can be varied according to the preference of a designer and according to the available materials.

In operation, the quick disconnect hinge operates by rotating the end of the shelf 133, 145 or 150 upwardly so that the rod rotates within the channel. The rod may then be simply pulled straight from the channel and the male component withdrawn from the female component.

Without further elaboration, it is believed that one skilled in the art can, using the preceding description, utilize the present invention to its fullest extent. The following preferred specific embodiments are, therefore, to be construed as merely illustrative, and not limitative of the remainder of the disclosure in any way whatsoever.

What is claimed is:

1. A quick disconnect hinge, the hinge comprising a male component and a female component, the male component comprising a rod and a shelf, the shelf having top and bottom surfaces and sides, wherein one end of the top surface of the shelf is fixed to the rod, the rod having a circular cross section of a selected diameter, wherein at least a portion of the side of the shelf adjacent to the end of the top surface fixed to the rod protrudes outwardly from the diameter of the circular cross section;

the female component comprising a channel adapted to receive the male component, the cross section of the channel comprising two sectors, the first sector being a partially circular curve that has a length less than half of the diameter of the entire circle defined by the partially circular curve, and the second sector having a concave shape that connects the bottom end of the first sector to the side of the female component, wherein the diameter of the circle defined by the curve of the first sector is at least the diameter of the rod portion of the male component.

2. The quick disconnect hinge described in claim 1, wherein the portion of the side of the shelf adjacent to the end of the top surface fixed to the rod that protrudes outwardly from the diameter of the circular cross section is perpendicular to the bottom surface of the shelf.

3. The quick disconnect hinge described in claim 1, wherein the entire side of the shelf adjacent to the end of the top surface fixed to the rod protrudes outwardly from the diameter of the circular cross section.

4. The quick disconnect hinge described in claim 1, wherein the rod and the shelf are a single piece of material.

* * * * *